US010979798B2

(12) United States Patent
Luo et al.

(10) Patent No.: US 10,979,798 B2
(45) Date of Patent: Apr. 13, 2021

(54) HEADPHONE WITH A HEADBAND GUIDING MECHANISM

(71) Applicant: GN Audio A/S, Ballerup (DK)

(72) Inventors: Andy Luo, Ballerup (DK); Mads Schenstrøm Stefansen, Ballerup (DK); Libra Su, Ballerup (DK); Silas Zhang, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 16/717,464

(22) Filed: Dec. 17, 2019

(65) Prior Publication Data

US 2020/0213709 A1 Jul. 2, 2020

(30) Foreign Application Priority Data

Dec. 27, 2018 (CN) ..... 201811612090.4
Jan. 5, 2019 (DK) ..... PA 201900011

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
CPC combination set(s) only.
See application file for complete search history.

(56) References Cited

U.S. PATENT DOCUMENTS 5,117,465 A 5/1992 MacDonald
2014/0023222 A1* 1/2014 Ito ..... H04R 1/105 381/379
2017/0257695 A1* 9/2017 Smiechowski ..... H04R 1/1066

FOREIGN PATENT DOCUMENTS

CN 203675282 6/2014
CN 203872322 10/2014
(Continued)

OTHER PUBLICATIONS

1st Technical examination of the Danish priority application No. PA 2019 00011 dated Aug. 7, 2019.
(Continued)

*Primary Examiner* — Fan S Tsang
*Assistant Examiner* — Angelica M McKinney
(74) *Attorney, Agent, or Firm* — Hamre, Schumann, Mueller & Larson, P.C.

(57) ABSTRACT

A headphone (1) comprising a first earphone (2) and a headband (3) to be arranged around the head of a user. The headband (3) comprises a first headband part (4) and a second headband part (5), that are telescopically connected, so that the length of the headband (3) can be adjusted in a longitudinal direction (Y). The first headband part (4) comprises an inner wall (9) with a protruding longitudinal first rib (8), which first rib (8) has a first rib sidewall (35) with a first rib protrusion (33) and a second opposite rib sidewall (36) with a second rib protrusion (34). The second headband part (5) comprises an outer wall (7) with a first longitudinal groove (6), which first groove (6) has first groove sidewall (20) with a first groove protrusion (22) and a second opposite groove sidewall (21) with a second groove protrusion (23). The first rib (8) is received in the first groove (6), and the first and second rib protrusions (33, 34) and the first and second groove protrusions (22, 23) defines small well-defined contact areas between the rib sidewalls (35, 36) and the groove sidewalls (20, 21).

10 Claims, 3 Drawing Sheets

(56) References Cited

FOREIGN PATENT DOCUMENTS

| | | | |
|---|---|---|---|
| CN | 204540926 | | 8/2015 |
| CN | 206332813 | | 7/2017 |
| JP | S5876287 | U | 5/1983 |
| JP | S5961687 | U | 4/1984 |
| JP | 2002262381 | A | 9/2002 |
| WO | 2016/059832 | | 4/2016 |

OTHER PUBLICATIONS

The extended European search report issued in European Application No. 190209480.3, dated May 25, 2020, 13 pages provided.

* cited by examiner

HEADPHONE WITH A HEADBAND GUIDING MECHANISM

TECHNICAL FIELD

The invention relates to headphone comprising a first earphone and a headband to be arranged around the head of a user, wherein the headband comprises a first headband part and a second headband part, that are telescopically connected, so that the length of the headband can be adjusted in a longitudinal direction.

BACKGROUND ART

Headphones with headbands are normally adjustable in way, where the length of the headband can be adjusted in order to adapt the headphone to the size of the user's head. Duo headphones comprise two earphones, which are interconnected by the headband. Monaural headphones comprise just one earphone at one end of the headband and an abutment device at the other end of the headband. The length adjustability mechanism of the headband can be carried out in many ways. The object of the invention is to provide a new and simple mechanical length adjustability mechanism.

DISCLOSURE OF INVENTION

The headphone according to the invention characterized in that the first headband part comprises an inner wall with a protruding longitudinal first rib, which first rib has a first rib sidewall with a first rib protrusion and a second opposite rib sidewall with a second rib protrusion, and wherein the second headband part comprises an outer wall with a first longitudinal groove, which first groove has first groove sidewall with a first groove protrusion and a second opposite groove sidewall with a second groove protrusion, and wherein the first rib is received in the first groove, and wherein the first and second rib protrusions and the first and second groove protrusions defines small well-defined contact areas between the rib sidewalls and the groove sidewalls. With such sliding mechanism, it is possible to obtain a telescopic movement with very little play, which gives a good feeling of quality for the user.

According to an embodiment, the inner wall has a protruding longitudinal second rib, which second rib has a first rib sidewall with a first rib protrusion and a second opposite rib sidewall with a second rib protrusion, and wherein the outer wall has a second longitudinal groove with a first groove sidewall with a first groove protrusion and a second opposite groove sidewall with a second groove protrusion, and wherein the second rib is received in the second groove, wherein the first and second rib protrusions and the first and second groove protrusions defines small well-defined contact areas between the rib sidewalls and the groove sidewalls.

According to an embodiment, the first groove and the second groove are provided on opposite sides of the second headband part.

According to an embodiment, the second headband part comprises a bottom face facing the users head when the headphone is worn, a top face opposite the bottom face, and two side faces connecting the bottom face and the top face, wherein the first and second grooves are provided in the two side faces.

According to an embodiment, the first headband part comprises a first end and a second end, wherein the second headband part is received in the first end, and wherein the first rib and the second rib has a first end part, which is located at the first end.

According to an embodiment, the first and second grooves have a first end and where the first groove protrusion is arranged at first distance from the first end, and where the second protrusion is arranged at a second distance from the first end.

According to an embodiment, a knob is arranged at the first end of the first and second ribs, which knob defines the first and second rib protrusions.

According to an embodiment, a recession is provided in the second groove sidewall opposite the first groove protrusion, which recession is adapted to let the knob pass the first protrusion during initial assembly of the first headband part and the second headband part.

According to an embodiment, the rib(s) and the sidewalls of the grooves are made of moulded plastics.

According to an embodiment the groove(s) and rib(s) are curved. If the ribs and grooves were not provided with the well-defined four contact areas, it would require a mechanism with a large play due to production tolerances, especially when moulding plastics.

BRIEF DESCRIPTION OF THE DRAWINGS

The invention is explained in detail below with reference to the drawing illustrating a preferred embodiment of the invention and in which.

MODES FOR CARRYING OUT THE INVENTION

Figure 1:
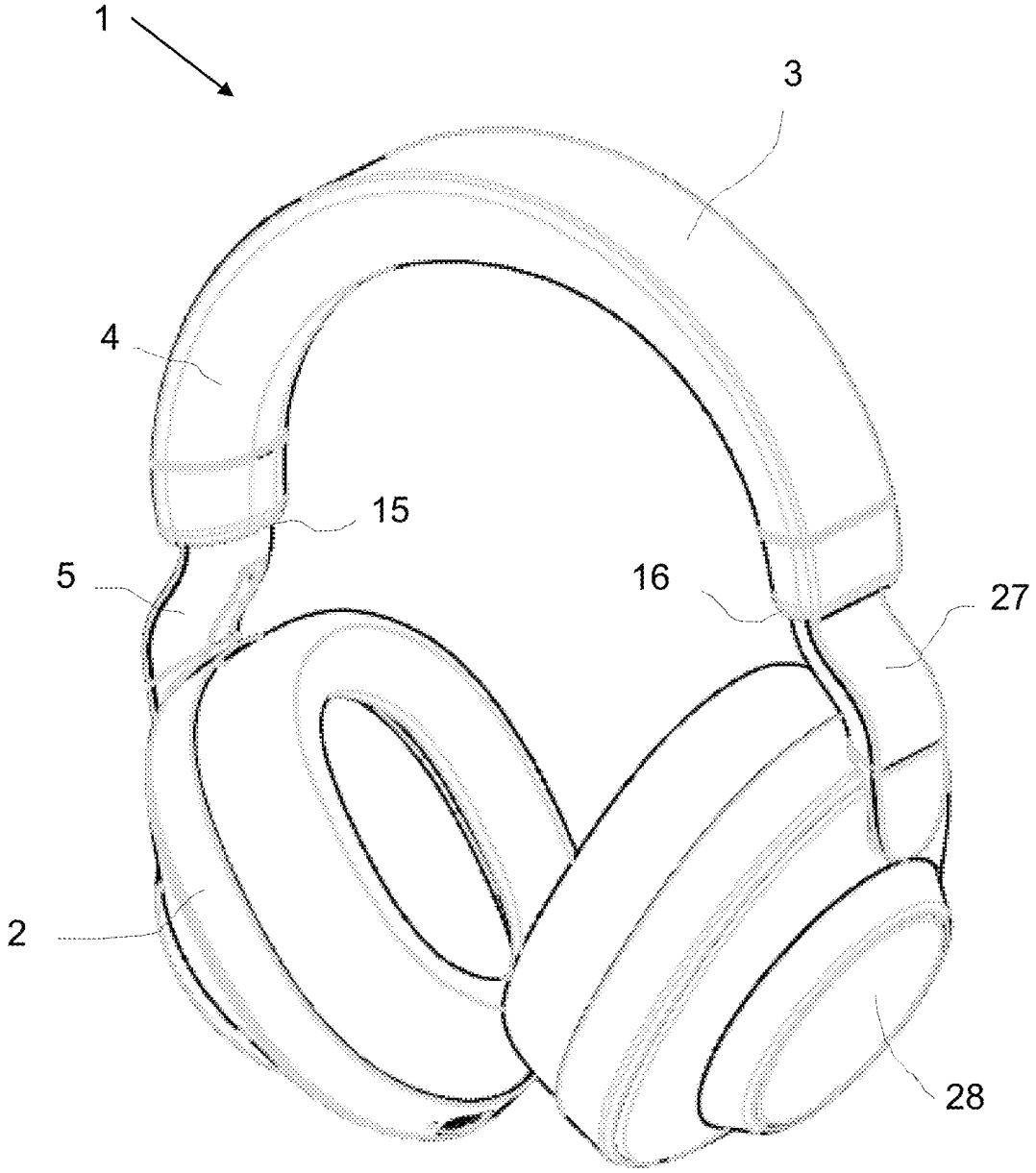
FIG. 1 is a perspective view of a headset according to the invention, FIG. 2. is a top-part of a second headband part, FIG. 3. is a bottom-part of the second headband part.

FIG. 1 is a perspective view of a headset 1 according to the invention. The headphone 1 comprises a headband 3 interconnecting a first earphone 2 and a second earphone 28. The headband 3 comprises a first headband part 4, a second headband part 5 and a third headband part 27. The second and third headband parts 5, 27 are telescopically received in each end 15, 16 of the first headband part 4. As the sliding mechanism between the first headband part 4 and each of the second and third headband parts 5, 27 are similar, only the sliding mechanism between the first and second headband parts 4, 5 will be described in the following.

Figure 2:
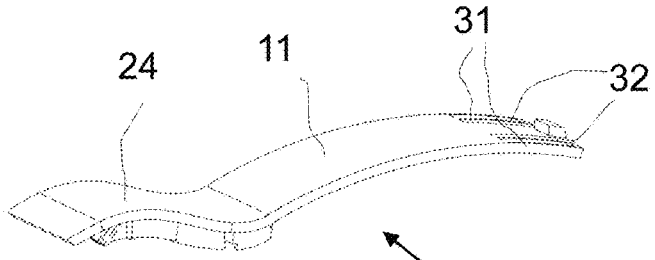
Figure 3:
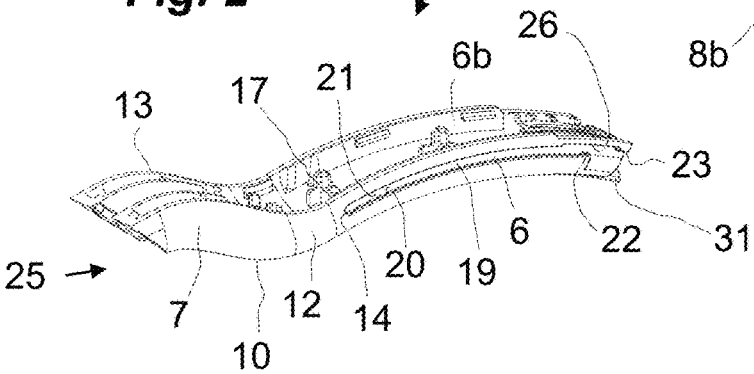

FIG. 2. is a top-part 24 of the second headband part 5. FIG. 3. is a bottom-part 25 of the second headband part 5. They are plastic parts, which are snapped together by means of snapping members 17. When snapped together, the second headband part 5 comprises an outer wall 7 with a bottom face 10, a top face 11 and two side faces 12, 13. Each side face 12, 13 comprises a longitudinal groove 6 with a first end 14, a bottom wall 19, a lower first side wall 20 and an upper second sidewall 21. The lower side wall 20 has a first groove protrusion 22 at a first distance from the first end 14. The upper side wall 21 has a second groove protrusion 23 at a second distance from the first end 14. The upper side wall 22 also has a recession 26 opposite the first groove protrusion 22. In assembled condition the left end of the second headband part 5 is attached to the first earphone 2. The right end of the second headband part is received in the first headband part 4 in assembled condition. At the right end the top-part 24 there are two cantilevers 31 with a recession 32. The recession 32 is for receiving a friction element of silicone rubber or the like. Also, the bottom part 25 has at the right end a cantilever 31 for receiving a friction element. In assembled state the cantilevers are bended and presses the friction elements against the inner wall 9 of the first headband part 4.

Figure 4:
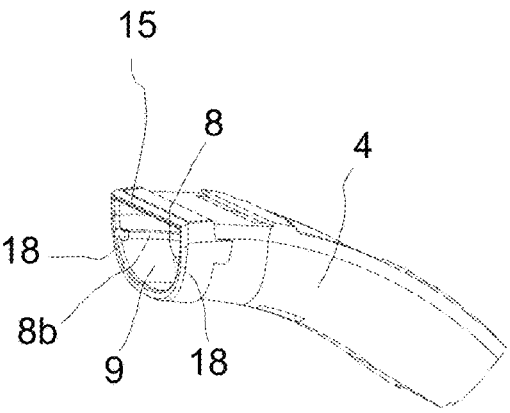
FIG. 4 is a part of a first headband part.

FIG. 4 is a part of a first headband part 4. The first headband part 4 has an open end 15, which can receive the second headband part 5. An internal wall 9 of the first headband part 4 comprise two opposite ribs 8, 8*b* with a knob 18 at arranged at the end. The knob 18 has a thickness which is slightly smaller than the distance between the side walls 20, 21 of the grooves 6, 6*b*.

Figure 5:
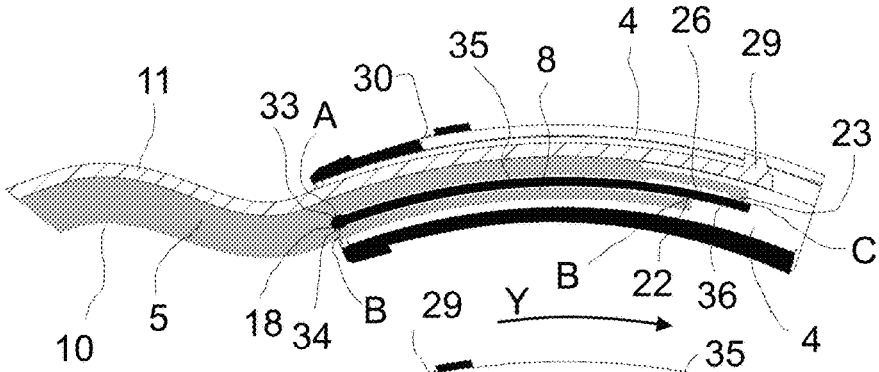
FIG. 5 is a cross-sectional view through a headband sliding mechanism between the first and second headband parts in a first telescopic position.

FIG. 5 is a cross-sectional view through a sliding mechanism between the first and second headband parts 4, 5 in a first telescopic position. In this position the knob 18 is positioned at the first end 14 of the groove 6. The first rib 8 comprises an upper first rib sidewall 35 and a lower second rib sidewall 36. The knob 18 provides a first rib protrusion 33 of the first rib sidewall 35 and a second rib protrusion 34 of the second rib sidewall 36. The rib 6 also abuts the first protrusion 22 and second protrusion 23. Thus, the rib 6 is guided by four small delimited contact areas: A first contact area A between the first rib protrusion 33 and the second groove sidewall 21, a second contact area B between the second rib protrusion 34 and the first rib sidewall 20, a third contact area C between the second groove protrusion 23 and the first rib sidewall 35 and a fourth contact area D between the first groove protrusion 22 and the second rib sidewall 36. In practice, often only two of the four contact areas are in contact at the same time due to bending forces acting on the headband. Thus, contact areas A+D or B+C are "active" simultaneously. By "active" is meant, that the "active" contact areas are transferring the forces between the rib and groove. It is possible to dimension the parts, so that all contact areas are in touch simultaneously, but this may not be advantageous, as production tolerances and wear make it difficult to do that. However, the four contact areas are well-defined and being the only possible contact areas of the groove/rib structure. With a curved guiding structure like this, there is a high risk, that production tolerances may cause the rib to be wedged in the groove, which may require the user to use extraordinary forces to extend or shorten the headband 3. In the position shown in FIG. 5, the second headband part 5 is slid as long as possible into the first headband part 4.

Figure 6:
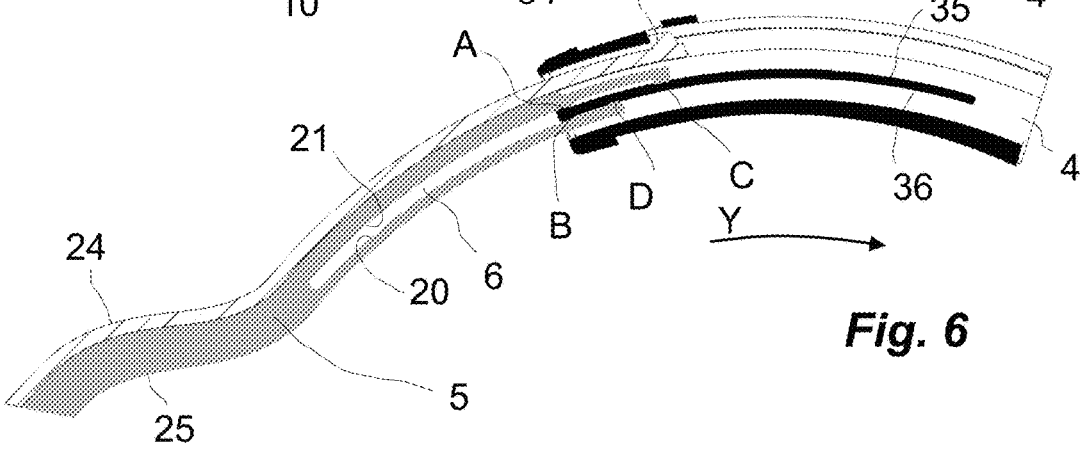
FIG. 6 is a cross-sectional view through the headband sliding mechanism between the first and second headband parts in a second telescopic position.

FIG. 6 shows the first and second headband parts 4, 5 in a second telescopic position. Here the second headband part 5 is retracted as long as possible out from the first headband part 4. Here the contact areas A and B is much closer to the contact areas C and D. The rib 8 is slightly wedge-shaped, so that it widens slightly from right to left. Thus, the play is smaller in the second position, whereby the user may not feel, that it is easier to tilt the first and second headband parts in relation to each other in the second position than in the first position, although the distance between the contact points are much smaller.

The cantilevers 31 and friction elements 32 force the knobs 18 against either the upper sidewall 21 or the lower sidewall 20 of groove 6. When the headphone 1 is arranged on the head of a user, the first headband part 3 is bent from a relaxed position, whereby a clamping force from the two earphones 2, 28 is directed at the head of the user. In this situation and external reactional force form the user's head is directed at the second headband part 5 in an upward direction in FIGS. 5 and 6. This will cause the contact areas B and C to be "active". If the user bends the headband 3 in the opposite direction, the contact areas A and D will be "active". The recession 26 is used during assembly to let the knob 18 pass the first protrusion 22. An upper protrusion 29 of the second headband part 4 abuts in the second telescopic position an end face 30 of the first headband part 4, which prevents the second headband part 5 from leaving the first headband part 4.

Figure 7:
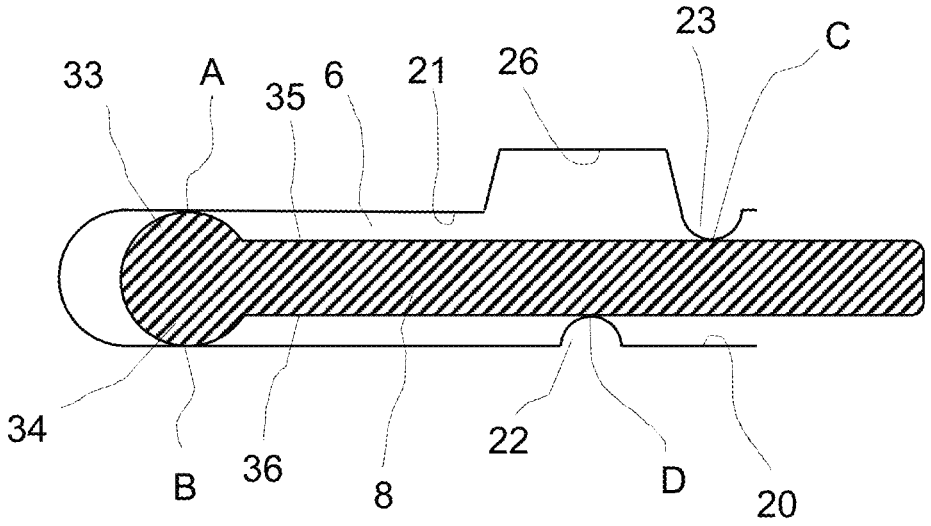
FIG. 7 is a schematic view of the sliding mechanism in a third telescopic position.
Figure 8:
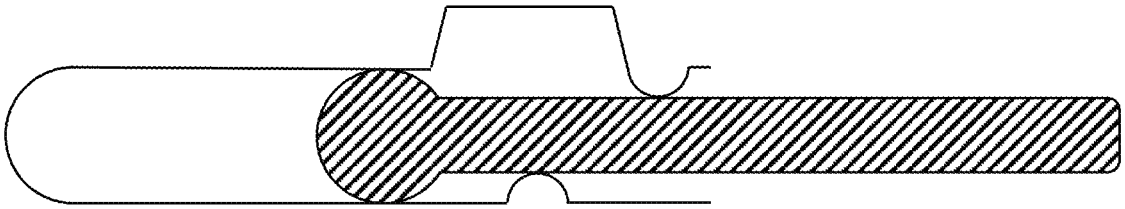
FIG. 8 is a schematic view of the sliding mechanism in the second telescopic position.

FIG. 7 is a schematic view of the sliding mechanism in a third telescopic position, and FIG. 8 is a schematic view of the sliding mechanism in the second telescopic position. These figures show what is shown in FIGS. 5 and 6 in a more schematic way.

REFERENCE SIGNS

A first contact area
B second contact area
C third contact area
D fourth contact area
1 headset
2 first earphone
3 headband
4 first headband part
5 second headband part
6 groove part
7 outer wall of second headband part
8 first rib
9 Inner wall of first headband part
10 bottom face of second headband part
11 top face of second headband part
12 side face of second headband part
13 side face of second headband part
14 first end of groove
15 first end of first headband part
16 second end of second headband part
17 snapping members
18 knob
19 bottom wall of grooves
20 first sidewall of groove
21 second sidewall of groove
22 first groove protrusion
23 second groove protrusion
24 top part of second headband part
25 bottom part of second headband
26 recess in second sidewall
27 third headband part
28 second earphone
29 locking protrusion
30 end face
31 cantilever
32 recess for friction element
33 first rib protrusion
34 second rib protrusion
35 first rib sidewall
36 second rib sidewall

The invention claimed is:

1. A headphone comprising a first earphone and a headband to be arranged around the head of a user, wherein the headband comprises a first headband part and a second headband part, that are telescopically connected, so that the length of the headband can be adjusted in a longitudinal direction, wherein the first headband part comprises an inner wall with a protruding longitudinal first rib, which first rib has a first rib sidewall with a first rib protrusion and a second opposite rib sidewall with a second rib protrusion, and wherein the second headband part comprises an outer wall with a first longitudinal groove, which first groove has first groove sidewall with a first groove protrusion and a second opposite groove sidewall with a second groove protrusion, and wherein the first rib is received in the first groove, and wherein the first and second rib protrusions and the first and second groove protrusions, defines small well-defined contact areas between the rib sidewalls, and the groove sidewalls.

2. A headphone according to claim 1, wherein the inner wall has a protruding longitudinal second rib, which second rib has a first rib sidewall with a first rib protrusion and a second opposite rib sidewall with a second rib protrusion, and wherein the outer wall has a second longitudinal groove with a first groove sidewall with a first groove protrusion and a second opposite groove sidewall with a second groove protrusion, and wherein the second rib is received in the second groove, wherein the first and second rib protrusions and the first and second groove protrusions defines small well-defined contact areas between the rib sidewalls and the groove sidewalls.

3. A headphone according to claim 2, wherein the first groove and the second groove are provided on opposite sides of the second headband part.

4. A headphone according to claim 3, wherein the second headband part comprises a bottom face facing the users head when the headphone is worn, a top face opposite the bottom face, and two side faces connecting the bottom face and the top face, wherein the first and second grooves are provided in the two side faces.

5. A headphone according to claim 4, wherein the first headband part and a second end and a second end, wherein the second headband part is received in the first end, and wherein the first rib and the second rib has a first end part, which is located at the first end.

6. A headphone according to claim 5, wherein the first and second grooves have a first end and where the first groove protrusion is arranged at first distance from the first end, and where the second protrusion is arranged at a second distance from the first end.

7. A headphone according to claim 6, wherein a knob is arranged at the first end of the first and second ribs, which knob defines the first and second rib protrusions.

8. A headphone according to claim 7, wherein a recession is provided in the second groove sidewall opposite the first groove protrusion, which recession is adapted to let the knob pass the first protrusion during initial assembly of the first headband part and the second headband part.

9. A headphone according to claim 8, wherein the rib(s) and the sidewalls of the grooves are made of moulded plastics.

10. A headphone according to claim 9, wherein the groove(s) and rib(s) are curved.

* * * * *